US006715956B1

(12) United States Patent
Weber et al.

(10) Patent No.: US 6,715,956 B1
(45) Date of Patent: Apr. 6, 2004

(54) WALKWAY SYSTEM

(76) Inventors: Robert M. Weber, Rural Route 7, Markdale, Ontario (CA), N0C 1H0; Teresa L. Weber, Rural Route 7, Markdale, Ontario (CA), N0C 1H0

( * ) Notice: Subject to any disclaimer, the term of this patent is extended or adjusted under 35 U.S.C. 154(b) by 0 days.

(21) Appl. No.: 10/356,806

(22) Filed: Feb. 3, 2003

(51) Int. Cl.[7] ..... E01C 17/00

(52) U.S. Cl. ..... 404/18; 404/22; 404/34; 404/41; 404/71

(58) Field of Search ..... 404/18, 17, 22, 404/27, 28, 29, 34, 40, 41, 44, 71

(56) References Cited

U.S. PATENT DOCUMENTS 2,346,304 A * 4/1944 Henderson et al. ..... 244/114 R
2,388,114 A 10/1945 Boyce
2,836,108 A * 5/1958 Monick ..... 404/40
2,933,337 A 4/1960 Katz
3,779,324 A 12/1973 Kreske, Jr.
4,445,802 A * 5/1984 Loov ..... 404/40
4,892,250 A * 1/1990 Fuller et al. ..... 239/18
5,100,175 A 3/1992 Swallow et al.
5,395,179 A * 3/1995 Kotani ..... 404/71
D364,173 S 11/1995 Woods
5,816,738 A * 10/1998 Harnapp ..... 404/18
6,237,861 B1 5/2001 Northrop et al.

* cited by examiner

*Primary Examiner*—Gary S. Hartmann

(57) ABSTRACT

A walkway system for providing a non-slip walkway path for users. The walkway system includes a plurality of trays each having bottom and side walls with the trays being embedded in a ground surface; and also includes a plurality of walk-upon cover members being removably and securely locked upon the trays and being disposed upon the ground surface; and further includes a light assembly being disposed upon the trays; and also includes a heating assembly being disposed upon the trays for preventing ice from accumulating upon the walk-upon covers.

8 Claims, 3 Drawing Sheets

WALKWAY SYSTEM

BACKGROUND OF THE INVENTION

1. Field of the Invention

The present invention relates to walkways and more particularly pertains to a new walkway system for providing a nonslip walkway path for users.

2. Description of the Prior Art

The use of walkways is known in the prior art. More specifically, walkways heretofore devised and utilized are known to consist basically of familiar, expected and obvious structural configurations, notwithstanding the myriad of designs encompassed by the crowded prior art which have been developed for the fulfillment of countless objectives and requirements.

SUMMARY OF THE INVENTION

The general purpose of the present invention, which will be described subsequently in greater detail, is to provide a new walkway system which has many of the advantages of the walkways mentioned heretofore and many novel features that result in a new walkway system which is not anticipated, rendered obvious, suggested, or even implied by any of the prior art walkways, either alone or in any combination thereof. The present invention includes a plurality of trays each having bottom and side walls with the trays being embedded in a ground surface; and also includes a plurality of walk-upon cover members being removably and securely locked upon the trays and being disposed upon the ground surface; and further includes a light assembly being disposed upon the trays; and also includes a heating assembly being disposed upon the trays for preventing ice from accumulating upon the walk-upon covers. None of the prior art includes the combination of the elements of the present invention.

There has thus been outlined, rather broadly, the more important features of the walkway system in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new walkway system which has many of the advantages of the walkways mentioned heretofore and many novel features that result in a new walkway system which is not anticipated, rendered obvious, suggested, or even implied by any of the prior art walkways, either alone or in any combination thereof.

Still another object of the present invention is to provide a new walkway system for providing a non-slip walkway path for users.

Still yet another object of the present invention is to provide a new walkway system that is easy and convenient to set up and use.

Even still another object of the present invention is to provide a new walkway system that is safer to walk upon than conventional cement slabs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
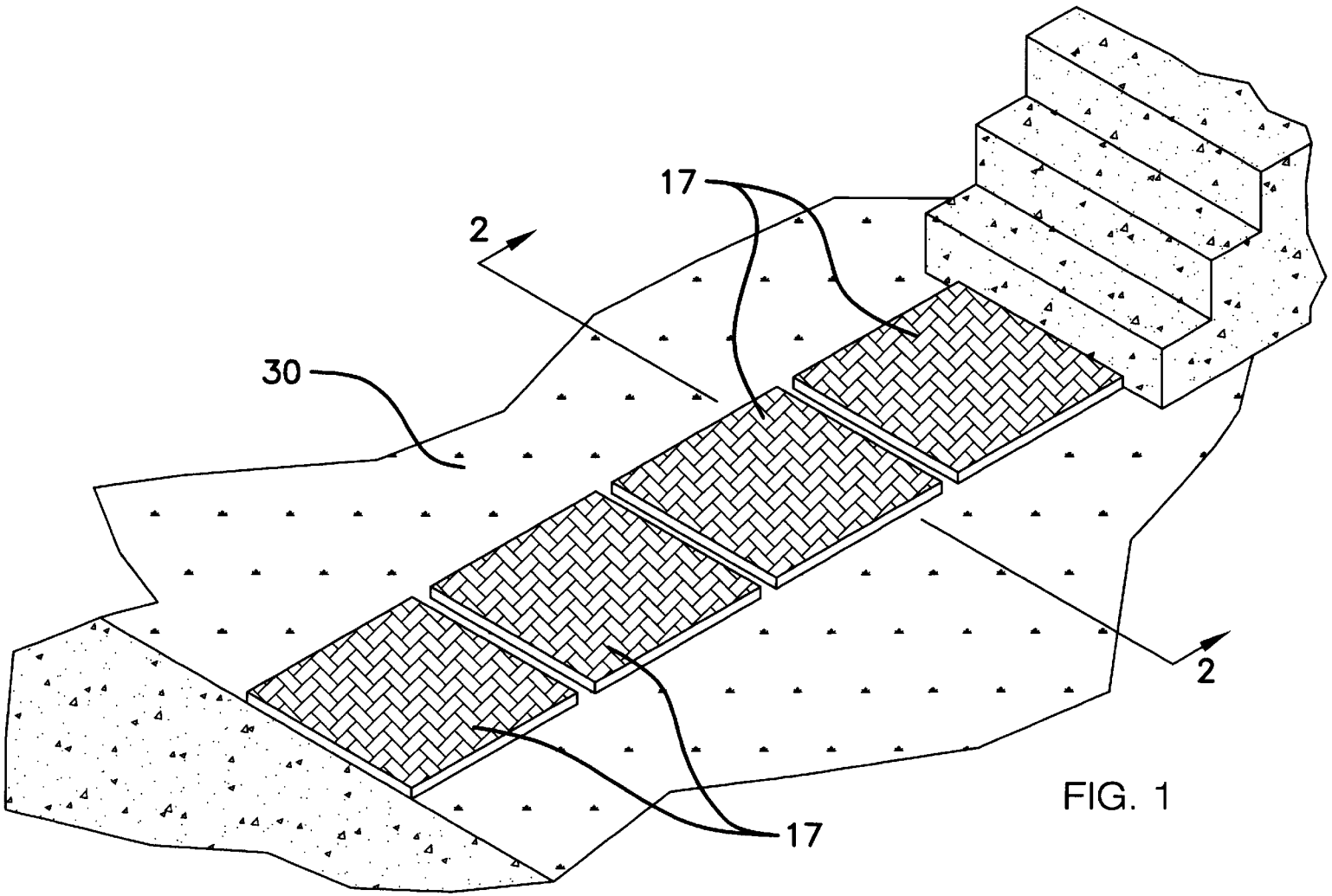
FIG. 1 is a perspective view of a new walkway system according to the present invention.
Figure 2:
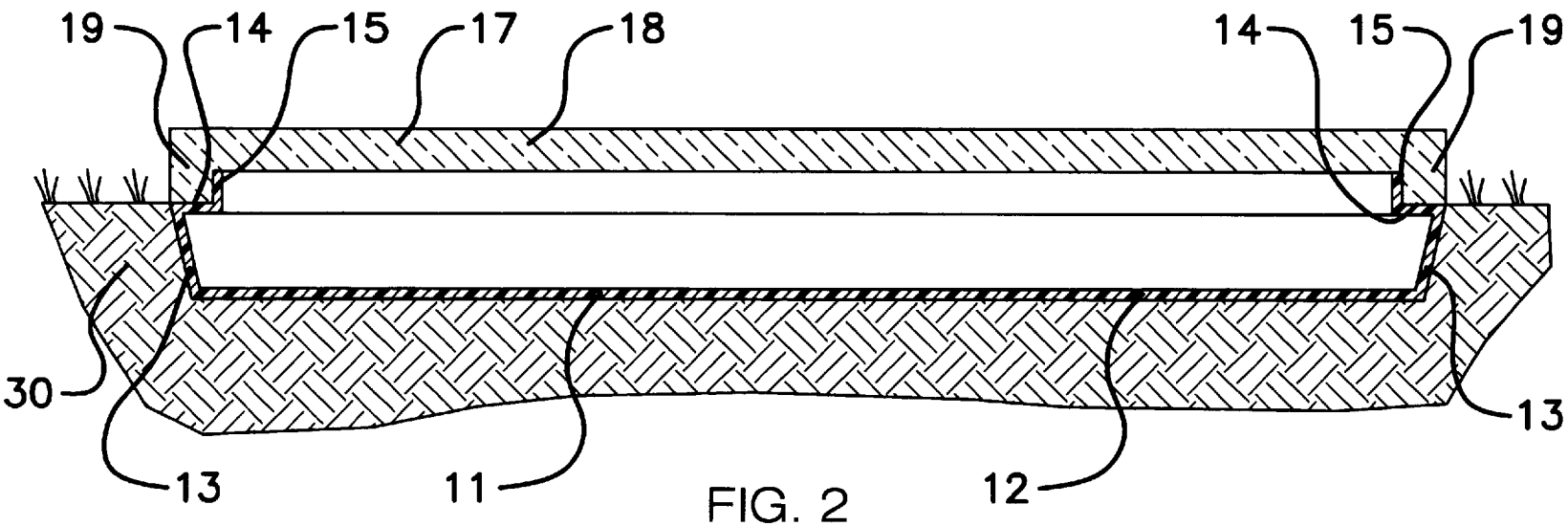
FIG. 2 is a side elevational view of the present invention.
Figure 3:
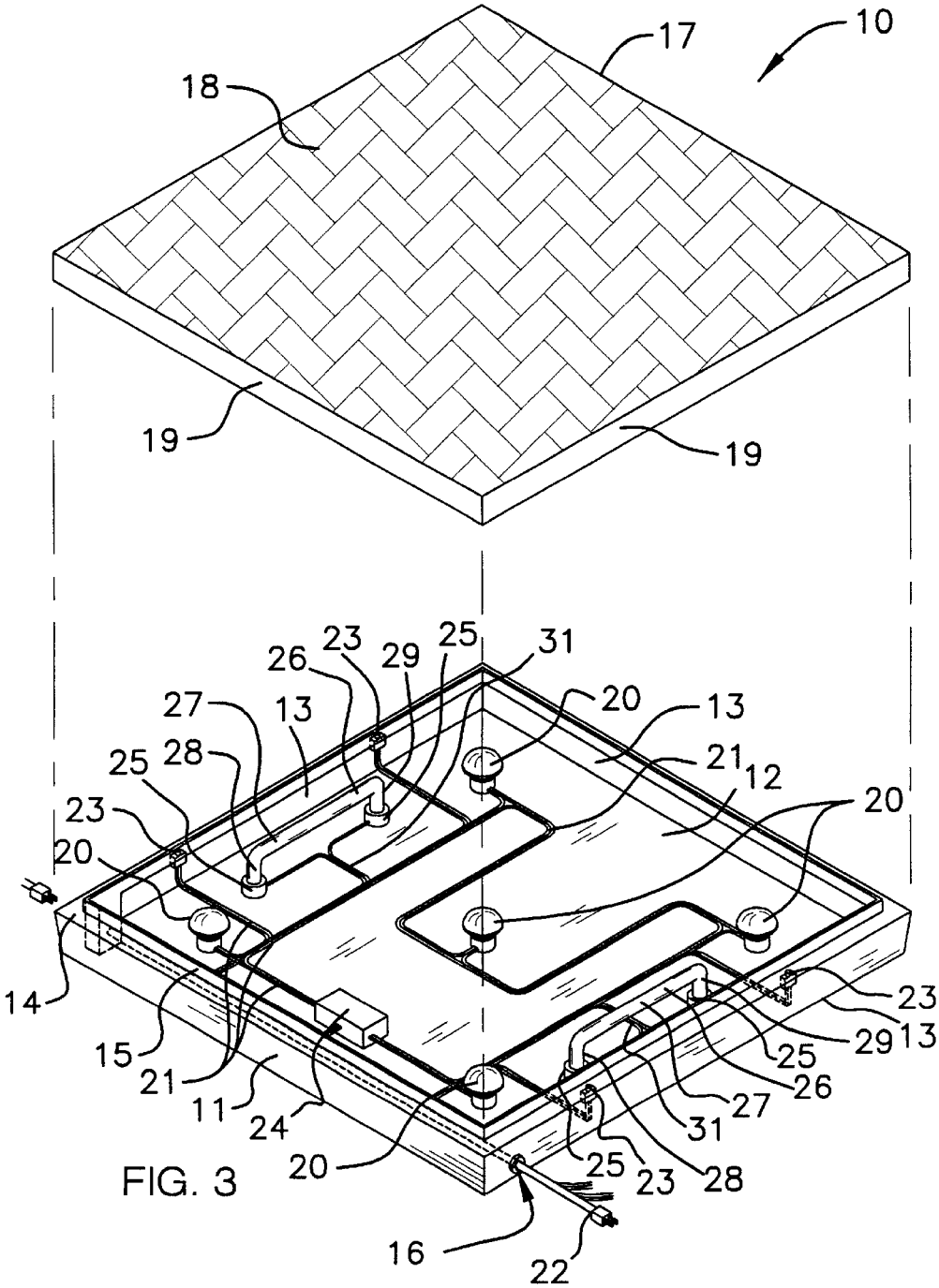
FIG. 3 is an exploded perspective view of the present invention.

With reference now to the drawings, and in particular to FIGS. 1 through 3 thereof, a new walkway system embodying the principles and concepts of the present invention and generally designated by the reference numeral 10 will be described.

As best illustrated in FIGS. 1 through 3, the walkway system 10 generally comprises a plurality of trays 11 being arranged to form a walkway and each having bottom and side walls 12,13 with the trays 11 being embedded in a ground surface 30. Each of the trays 11 also includes a rim 14,15 being integrally disposed along a top edge of the side walls 13. The rim 14,15 has a first portion 14 which is disposed inwardly of the tray 11 and disposed generally parallel to the bottom wall 12. The rim 14,15 also has a second portion 15 which is disposed upwardly of the tray 11 and disposed generally parallel to the side walls 12. Each of the trays 11 further includes a hole 16 being disposed through one of the side walls 13 thereof.

A plurality of walk-upon cover members 17 are removably and securely locked upon the trays 11 and are disposed above the ground surface 30. Each of the walk-upon cover members 17 includes top and side walls 18,19 with the side walls 19 interlocking with the second portion 15 of a respective rim 14,15. The top wall 18 has a non-slip top surface and also has a particular pattern disposed upon the non-slip top surface. The trays 11 and the walk-upon cover members 17 are made of plastic material, and the walk-upon cover members 17 are also transparent.

A light assembly is disposed upon the trays 11. The light assembly includes a plurality of light-emitting members 20 being spacedly and securely disposed upon the bottom walls 12 of the trays 11, and also includes electrical wires 21 being securely connected to the light-emitting members 20, and further includes a power cord 22 being securely connected to the electrical wires 21 and being disposed through the holes 16 of the trays 11, and also includes pressure-sensitive switches 23 being spacedly and securely disposed in the trays 11 and being securely connected to the electrical wires 21 for energizing the light-emitting members 20 when a user walks thereupon, and further includes a timer switch 24 being securely disposed inline of the power cord 22 for turning off the light-emitting members 20 after a selected period of time.

A heating assembly is securely disposed upon the trays 11 for preventing ice from accumulating upon the walk-upon cover members 17. The heating assembly includes a plurality of tubular support members 25 being securely disposed upon the bottom walls 12 of the trays 11, and also includes heating elements 26 being securely attached to the tubular support members 25, and further includes wire members 31 being securely attached to the heating elements 26 and being adapted to be connected to a power supply for the energizing of the heating elements 26. Each of the heating elements 26 is a bar having an elongate main portion 27 and angled end portions 28,29 which are securely disposed in the tubular support members 25.

In use, the user connects the power cord 22 to an electrical outlet for energizing the light-emitting members 20, and also connects the wire members 31 to a thermostat for energizing the heating elements 26 when a certain temperature is reached as set by the thermostat. The light-emitting members 20 are turned on when a user steps upon the walk-upon cover member 17 and upon the pressure-sensitive switches 23. The light-emitting members 20 illuminate the walk-upon cover members 17 so that the user can easily see where he/she is walking. After a period of time, the timer switch 24 will turn off the light-emitting members 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the walkway system. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A walkway system comprising:

a plurality of trays being arranged to form a walkway and each having bottom and side walls, said trays being embedded in a ground surface;

a plurality of walk-upon cover members being removably and securely locked upon said trays and being disposed above the ground surface;

a light assembly being disposed upon said trays; and a heating assembly being disposed upon said trays for preventing ice from accumulating upon said walk-upon cover members.

2. The walkway system as described in claim 1, wherein each of said trays also includes a rim being disposed along a top edge of said side walls, said rim having a first portion which is disposed inwardly of said tray and disposed generally parallel to said bottom wall, said rim also having a second portion which is disposed upwardly of said tray and disposed generally parallel to said side walls.

3. The walkway system as described in claim 2, wherein each of said trays further includes a hole being disposed through one of said side walls thereof.

4. The walkway system as described in claim 3, wherein each of said walk-upon cover members includes top and side walls, said side walls interlocking with said second portion of a respective said rim, said top wall having a non-slip top surface and also having a particular pattern disposed upon said non-slip top surface.

5. The walkway system as described in claim 4, wherein said trays and said walk-upon cover members are made of plastic material, said walk-upon cover members also being transparent.

6. The walkway system as described in claim 5, wherein said light assembly includes a plurality of light-emitting members being spacedly and securely disposed upon said bottom walls of said trays, and also includes electrical wires being connected to said light-emitting members, and further includes a power cord being connected to said electrical wires and being disposed through said holes of said trays, and also includes pressure-sensitive switches being spacedly disposed in said trays and being connected to said electrical wires for energizing said light-emitting members upon a user walking upon said walk-upon cover members, and further includes a timer switch being disposed inline of said power cord for turning off said light-emitting members after a selected period of time.

7. The walkway system as described in claim 6, wherein said heating assembly includes a plurality of tubular support members being disposed upon said bottom walls of said trays, and also includes heating elements being attached to said tubular support members, and further includes wire members being attached to said heating elements and being adapted to be connected to a power supply for the energizing of said heating elements.

8. The walkway system as described in claim 7, wherein each of said heating elements is a bar having an elongate main portion and angled end portions which are disposed in said tubular support members.

* * * * *